United States Patent [19]

Price

[11] 4,335,774

[45] Jun. 22, 1982

[54] THERMAL WINDOW BARRIER OF SOFT FABRIC

[76] Inventor: Timothy K. Price, Howe Hill Rd., Grantham, N.H. 03753

[21] Appl. No.: 111,964

[22] Filed: Jan. 14, 1980

[51] Int. Cl.[3] ..... A47H 5/00; E06B 3/94

[52] U.S. Cl. ..... 160/84 R; 160/DIG. 7; 160/329

[58] Field of Search ..... 160/84 R, 84 HV, 395, 160/382–388, DIG. 7, 100–102, 201, 207, 402–404, 271–276, 263 RS, 330, 329; 2/270, 97, 69.5

[56] References Cited

U.S. PATENT DOCUMENTS 1,693,209 11/1928 Peterson et al. ..... 160/382
2,138,610 11/1938 Overly ..... 2/274 X
3,055,419 9/1962 Rubin et al. ..... 160/84 R
4,079,772 3/1978 Klaenhammer et al. ..... 160/268 R
4,141,611 2/1979 DeLeon ..... 160/330

FOREIGN PATENT DOCUMENTS 332076 8/1903 France ..... 160/84 R
533457 2/1941 United Kingdom ..... 160/84

*Primary Examiner*—C. J. Husar
*Assistant Examiner*—Cherney S. Lieberman
*Attorney, Agent, or Firm*—Thomas N. Tarrant

[57] ABSTRACT

A thermal window barrier of quilted insulating fabric supported taut by springs connected to track runners and retractable in pleats.

6 Claims, 4 Drawing Figures

THERMAL WINDOW BARRIER OF SOFT FABRIC

BACKGROUND OF THE INVENTION

1. Field of the Invention

Present invention relates to thermal window barriers and particularly to insulation filled fabric barriers that can be retracted in pleats.

2. Relation to the Prior Art

Various methods have been used to insulate windows and other transparent panels to reduce the transmission of heat when such transmission is not desired. Simple window shades will block a considerable amount of direct radiation and reduce convection currents. More effective window shades have been made of multiple layers with air spaces between the layers and some form of seal at the edges. Highly insulated pocket panels have been made which slide into a wall adjacent a window and can be drawn across the window like a sliding door. Double glassed windows have been built with an arrangement for filling and emptying the inner air space with insulated beads. Curtains, shades, and drapes have also been made in multiple fabric layers using most of the materials known to be good for insulating. Metal foil or metalized layers have been used for reflecting radiation. Insulating fiberfill and various types of plastic foam have been used as insulating layers in such arrangements. Sections of rigid foam connected at the fold points by short lengths of flexible foam are useful for high "R" factor. The biggest difficulties with most of these relate to ease of extension and retraction with a minimum loss of insulating quality along the boundaries. The pocket panels are quite expensive in installation and require available wall space. The bead systems are also very expensive and tend to leave residual material intefering with light transmission.

SUMMARY OF THE INVENTION

The present invention provides a thermally insulating fabric window barrier having a plurality of rows of quilting securing said fabric at intervals. Springs are connected at intervals spaced from and along edges of the fabric and connected to carriers in a pair of opposing tracks for supporting the fabric taut between the tracks whereby the fabric may be extended and retracted in pleats.

Further objections and features of the invention will become apparent upon reading the following disclosure along with the drawing.

DESCRIPTION OF THE PREFERRED EMBODIMENT

Figure 1:
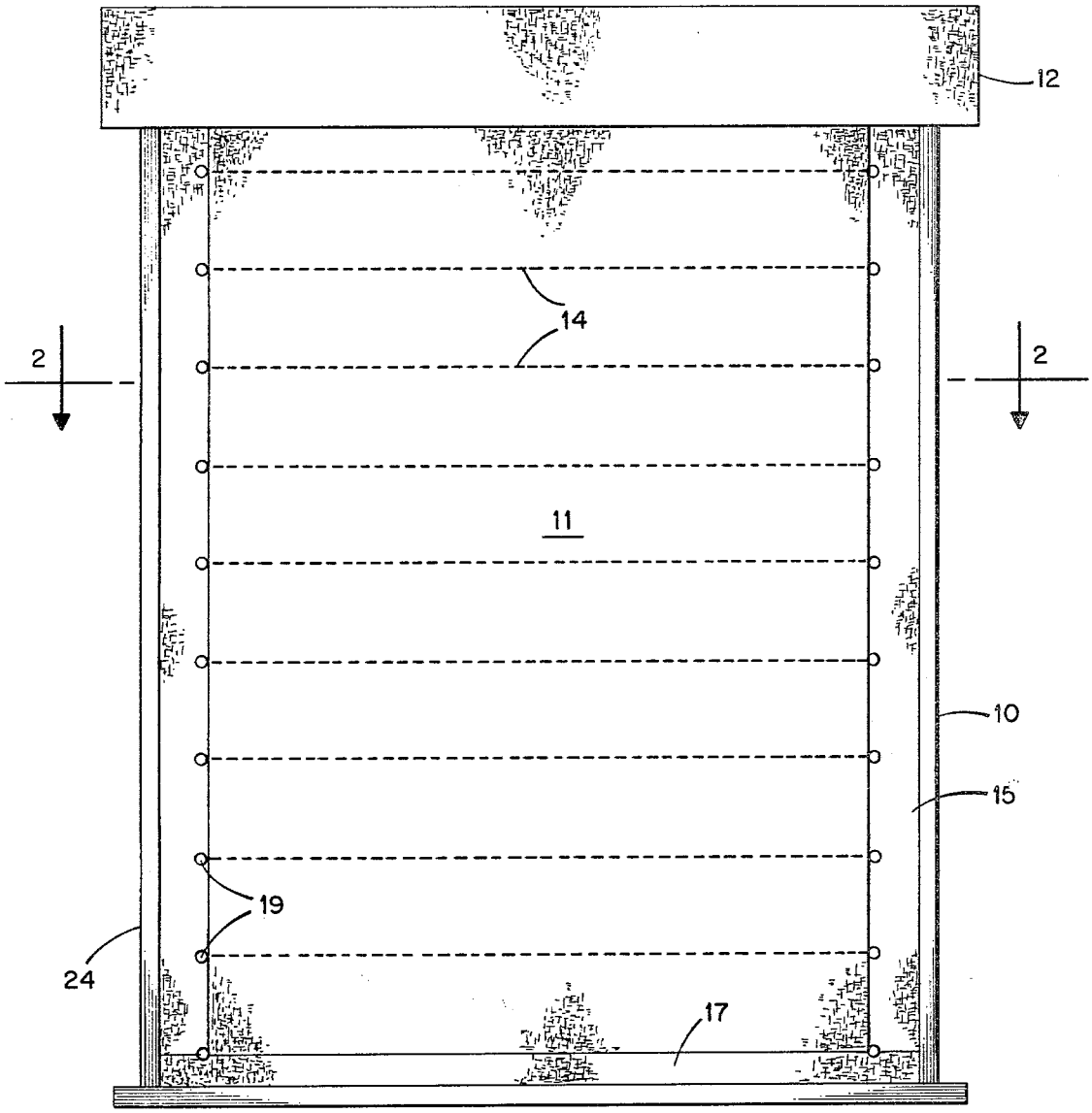
FIG. 1 is a front elevation depicting a thermal barrier according to the invention mounted on a building window as seen from the inside of the building.

The thermal window barrier of the present invention can be used on regular house windows, picture windows, patio doors, solar heating panels and various other types of window units. It may be arranged to extend and retract vertically, horizontally, diagonally or following some curvature. The extension and retraction can be powered by concealed motors. It can be done manually by pushing and pulling on the material itself or manually by a system of pull cords. When operation is by motor, it is contemplated that it be operated at will by a wall switch or automatically in accordance with the amount of sunlight in response to a light sensor. For purposes of this description, simple window unit as depicted in FIG. 1 is exemplary. Window 10 in FIG. 1 is a conventional house-window as viewed from the inside. Thermal barrier 11, according to the invention, is shown fully extended covering the window glass. Valance 12 is a box like structure at the top of the window for concealing thermal barrier 11 when it is retracted. Thermal barrier 11 is a multiple layer insulating filled soft fabric as will be described in fuller detail in connection with FIG. 3. Rows of quilting 14 are stitched across thermal barrier 11 in horizontal rows spaced at vertical intervals. Rows 14 are stitched with a suitable thread for securing the layers of material in thermal barrier 11 loosely together in the manner of quilting.

Figure 2:
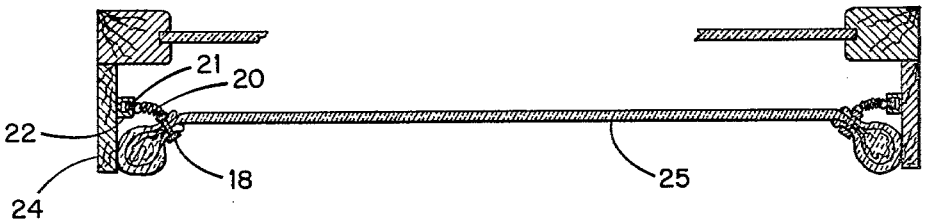
FIG. 2 is a section along 2—2 of FIG. 1.

Rolled edge borders 15 are secured along the two sides of thermal barrier 11 arranged to ride against jambs 24 to provide a seal. A similar rolled edge 17 is provided at the bottom of thermal barrier 11 both to seal the bottom and for providing a pocket, as will be described later for carrying a metal bar. Studs 18 having buttonlike heads 19 are located adjacent the point where each row of quilting 14 intersects with rolled edge 15. FIG. 2 shows a cross section of FIG. 1 depicting stud 18 passing through the material of thermal barrier 11 and having spring 20 connected through small hole 34 in the end of stud 18. The other end of spring 20 is connected to a carrier 21 riding in a track 22. Two tracks 22 are a pair with one running the length of each side of window 10. Window jamb 24 one on each side of window 10 carries a respective tract 22. One of studs 18 with an associated spring 20 and associate carrier 21 is provided at each intersection of a quilting row 14 and a rolled edge 15.

Figure 3:
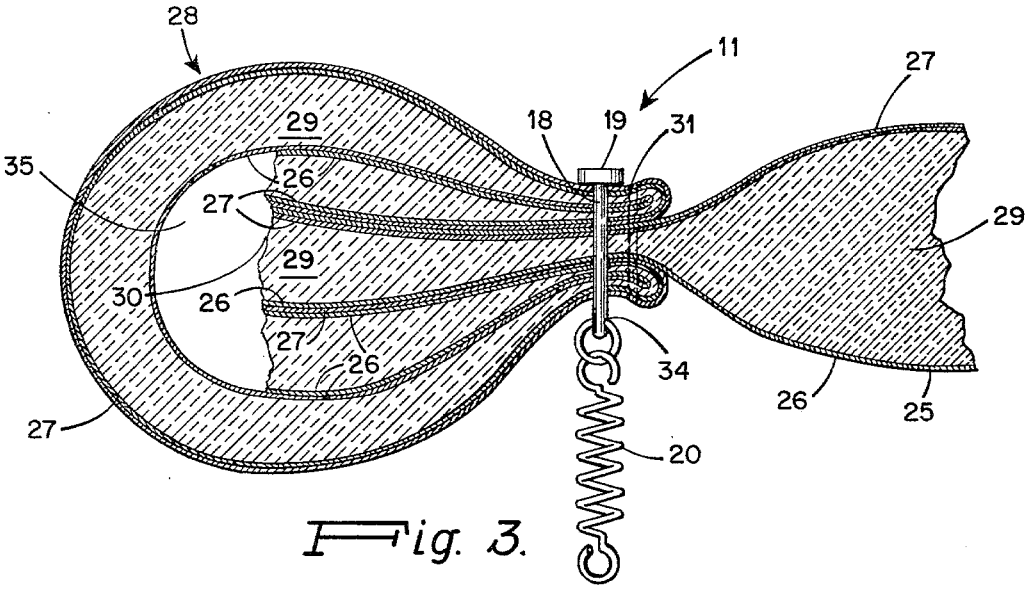
FIG. 3 is a cross section detail view of one edge of a fabric window barrier according to the invention.

Springs 20 are tension springs arranged to provide lateral pressure upon thermal barrier 11 so as to keep the thermal barrier taut. FIG. 3 depicts an enlarged detailed section of one edge of thermal barrier 11. The detail of FIG. 3 is shown unconnected to a window frame for ease of illustration. A portion of main barrier material 25 shows a first layer of fabric 26 on the side that would normally be adjacent to a window surface. A cotton polyester blend fabric has been used for layer 26 and other similar fabrics may be used. The side of material 25 that would normally face the inside of a building has a layer of cloth 27 which is suitably a metallized nylon and polyurethane material. Again other materials can be used with the understanding that it is desirably vapor proof and should have a reflective layer for reflecting radiated heat energy back into the building. While metal foil can be used both as a vapor barrier and for reflection, it does not usually take kindly to continuous folding and unfolding as would be the case when applied to the present thermal barrier. Between fabric layers 26 and 27, insulating fill 29 is used which is suitably a mat of polyester fiberfill. Again other materials may be used such as for example, down, or flexible foam plastic. A nominal thickness of $1\frac{1}{2}$ inches for thermal barrier material 11 has been used. Different thicknesses may be used in accordance with the desired R-factor.

Main barrier material 25 is bound at the edges by a strip of the same material that is folded around the edges as depicted in FIG. 3. The way this is done is a strip of the barrier material has both of its long edges rolled inward so as to leave layer 26 on the outside in forming a roll 28. The edges that are folded inward are suitably brought in about ½ the depth of roll 28. Edge 30 of main barrier material 25, is brought in between them to the same depth of roll 28. Roll 28 is then stitched along its length at seam 31 near the point at which edge 30 enters roll 28. Since roll 28 contains a double thickness of thermal barrier 11, its nominal diameter is 3 inches when barrier 11 has a nominal diameter of 1½ inches. Studs 18 are connected through roll 28 near seam 31 at each end of each row of binding 14. Studs 18 have a button head 19 at one end and hole 34 pierced through the other end for connection of springs 20. Roll 28 provides for small pocket 35 that extends its length. Pocket 35 is formed between the outer material 25 in roll 28 and the ends of the rolled in portions together with edge 30 of the main barrier material 25. Further roll 28 may also be used to enclose the bottom edge of a vertically hanging thermal barrier 11 as depicted in FIG. 1. When used at the bottom edge in that manner, a heavy rod or shaft may be passed the length of the bottom edge through pocket 35 as depicted by rod 36 in FIG. 4.

Figure 4:
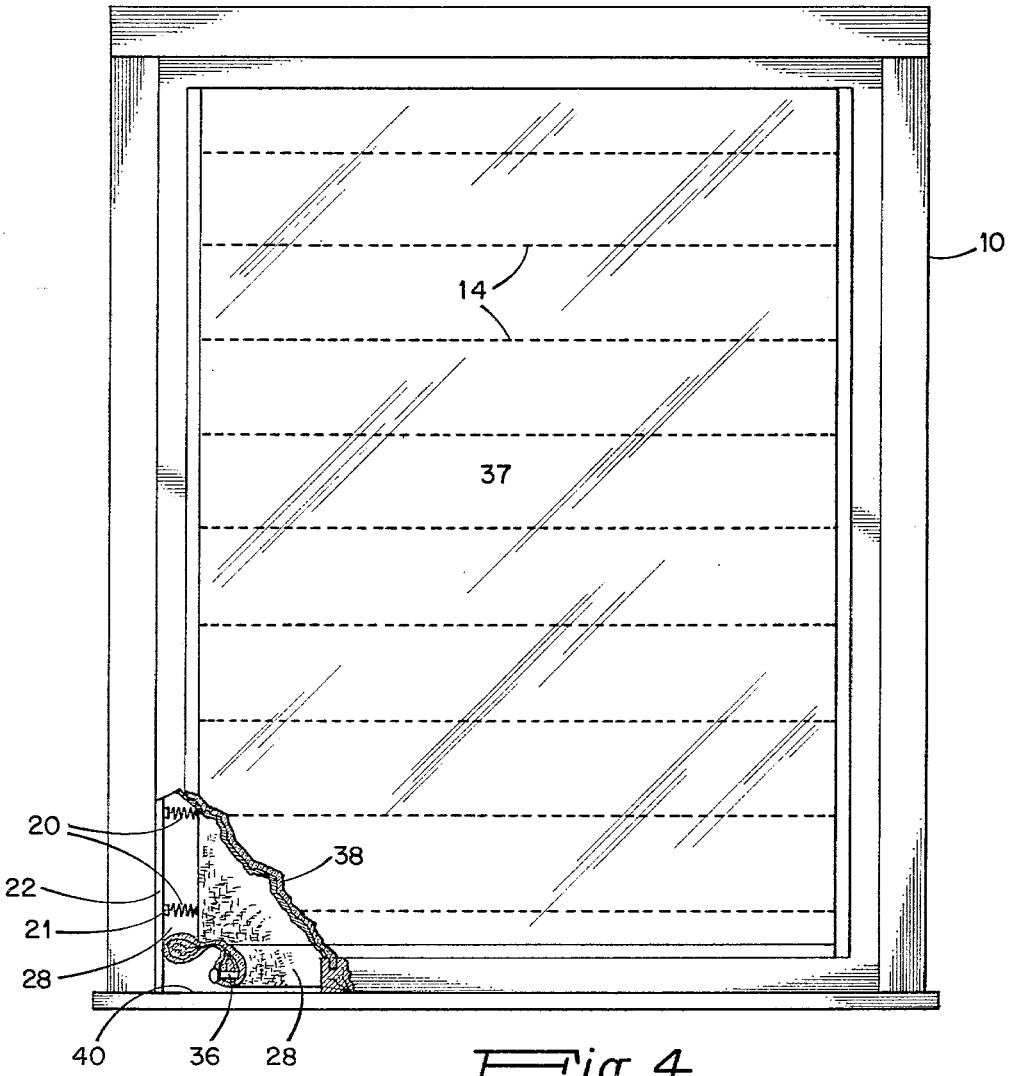
FIG. 4 is a rear elevation partially cut away of FIG. 1 as it would be seen from the outside of the building.

FIG. 4 depicts window 10 of FIG. 1 looking in from the outside of the building. A portion of window glass 37 is cut away at 38 to show rolls 28. Two of springs 20 are also depicted holding barrier material 25 taut and forcing rolls 28 against the jambs. Metal rod 36 holds the bottom roll 28 against windowsill 40 due to its weight. Vertical draw cords (not shown) may be connected to rod 36 for raising the thermal barrier. Tracks 22 and carrier 21 for guiding springs 20 as the thermal barrier is extended and retracted, are conventional as used for heavy drapes and other materials. Draw cords (not shown) preferably extend around pulleys at the bottom of the window to allow bottom roll of material 28 to be forced against a window sill under tension.

While the invention has been described in relation to a specific embodiment, it is contemplated that a variety of different materials may be used and the thermal barrier mounted for operation in various directions and for various purposes. Thus it is intended to cover the invention within the scope of the following claims.

I claim:

1. An insulating barrier for window areas comprising:

(a) a rectangular multiple-layer, insulating fabric containing at least one insulating filler layer and having a rolled edge of multiple-layer material similar to said insulating fabric also containing at least one insulating filler layer, said rolled edge extending along at least three edges of said barrier;

(b) a plurality of rows of quilting securing said fabric at intervals parallel to an edge of said fabric;

(c) a pair of tracks on opposite sides of said fabric aligned perpendicular to said rows;

(d) a pair of springs for at least every other row of quilting, one end of each spring in said pair of springs connected to a carrier in a respective one of said pair of tracks; and, (e) means to secure a second end of each spring to said fabric at a position spaced from the edge of said fabric and related to said rows of quilting, said position spaced from the edge of said fabric being such as to place a tension on said fabric to hold it taut between said tracks with said rolled edge in sealing contact against window jambs at two edges of said barrier, all whereby said fabric may be supported adjacent a window area, extended on said tracks to form a barrier for said window area and retracted from said window area on said tracks to fold in a storage zone.

2. An insulating barrier according to claim 1, wherein said rolled edge is made of a strip of insulating material having both its long edges rolled inward with the edge of said insulating fabric in between and a row of stitching to secure the rolled edge together and to the insulating fabric.

3. An insulating barrier according to claim 2 wherein said rolled edge has a nominal diameter of at least 3 inches.

4. An insulating barrier according to claim 3 wherein one of said rolled edges is a bottom edge of said insulating barrier and a metal shaft is provided inside said rolled edge as a support member and as a weight to hold the bottom rolled edge against a sill.

5. An insulating barrier for window areas comprising:

(a) a rectangular multiple layer insulating fabric;

(b) a plurality of rows of quilting securing said fabric at intervals parallel to an edge of said fabric;

(c) a rolled edge having a nominal diameter of at least three inches made from a multiple layer material similar to said insulating fabric extending along at least 3 edges of said barrier, said material being in the form of a strip having both its edges rolled inward with the edge of said fabric inbetween and secured by a row of stitching holding the rolled edge together and to said fabric;

(d) a pair of tracks mounted on the two jambs of a window on opposite sides of said fabric aligned perpendicular to said rows;

(e) a pair of springs for at least every other row of quilting one end of each spring in said pair of springs connected to a carrier in a respective one of said pair of tracks so that said springs force said rolled edge snuggly against said jambs for providing a seal; and, (f) means to secure a second end of each spring to said fabric at a position spaced from the edge of said fabric and related to said rows of quilting, said position spaced from the edge of said fabric being such as to place a tension on said fabric to hold it taut between said tracks all whereby said fabric may be supported adjacent a window area, extended on said tracks to form a barrier for said window area and retracted from said window area on said tracks to fold in a storage zone.

6. An insulating barrier for window areas comprising:

(a) a rectangular multiple layer insulating fabric;

(b) a plurality of rows of quilting securing said fabric at intervals parallel to an edge of said fabric;

(c) a rolled edge made from a multiple layer material similar to said insulating fabric extending along at least three sides of said barrier, said material being in the form of a strip having both its edges rolled inward with the edge of said fabric inbetween and secured by a row of stitching holding the rolled edge together and to said fabric;

(d) a pair of tracks on opposite sides of said fabric aligned perpendicular to said rows;

(e) a pair of springs for at least every other row of quilting one end of each spring in said pair of springs connected to a carrier in a respective one of said pair of tracks; and, (f) a stud passing through said rolled edge and said fabric adjacent to the stitching along said rolled edge to secure a second end of each spring to said fabric at a position spaced from the edge of said fabric being such as to place a tension on said fabric to hold it taut between said tracks all whereby said fabric may be supported adjacent a window area, extended on said tracks to form a barrier for said window area and retracted from said window area on said tracks to fold in a storage zone.

* * * * *